United States Patent [19]

Beghelli

[11] Patent Number: 4,976,633

[45] Date of Patent: Dec. 11, 1990

[54] IMPROVEMENT IN QUICK END CONNECTION SYSTEMS FOR LAMPS ESPECIALLY LAMP WITH A WEATHERPROOF HOUSING

[75] Inventor: Gian P. Beghelli, Monteveglio, Italy

[73] Assignee: G. P. B. Beghelli S.R.L., Monteveglio, Italy

[21] Appl. No.: 367,542

[22] Filed: Jun. 16, 1989

[30] Foreign Application Priority Data

Jun. 24, 1988 [IT] Italy ..... 3520 A/88

[51] Int. Cl.[5] ..... H01R 13/60

[52] U.S. Cl. ..... 439/571; 362/404

[58] Field of Search ..... 362/396, 409; 174/52.3, 174/54; 439/230, 535, 537, 271, 356, 280, 282, 366, 376, 557, 558, 571, 574–576

[56] References Cited

U.S. PATENT DOCUMENTS 1,170,690 2/1916 Skeel ..... 439/536 X
1,729,949 10/1929 Lofgren ..... 439/535
1,978,882 10/1934 Olley ..... 174/52.3 X

FOREIGN PATENT DOCUMENTS 1181814 11/1964 Fed. Rep. of Germany ..... 439/230

*Primary Examiner*—Eugene F. Desmond
*Attorney, Agent, or Firm*—Herbert Dubno

[57] ABSTRACT

This invention relates to an improvement in systems for the rapid attachment of lamps, especially lamps having a watertight housing, whereby a lamp may be connected in a single simple operation to its housing, a supporting plate previously attached to the ceiling (or a wall) and at the same time to a source of power, by means of suitable electrical connectors, forming an enclosed watertight unit in accordance with the applicable regulations.

3 Claims, 2 Drawing Sheets

IMPROVEMENT IN QUICK END CONNECTION SYSTEMS FOR LAMPS ESPECIALLY LAMP WITH A WEATHERPROOF HOUSING

FIELD OF THE INVENTION

This invention relates to an improvement in quick attachment and connection systems for lamps with a weatherproof housing, characterised in that both the mechanical and the electrical connection are made in a single operation.

BACKGROUND OF THE INVENTION

It is a known fact that a problem normally arises with both the electrical connection and the mechanical connection in the construction of lamp units for lighting of the industrial and civil type having a fluorescent tube or an incandescent lamp, which consist of an enclosing body or shell (housing) of heat-resistant or self-extinguishing polycarbonate resin incorporating a transparent diffuser.

Generally the known prior art lamps are attached mechanically by drilling holes in the ceiling or wall and inserting expanding plugs into the holes and connecting the lamps to electrical cables previously mounted in the ceiling or wall. All of these operations are time-consuming, laborious and not without disadvantages.

In addition to the difficulties and excessive time required both for mounting and for any maintenance operations which require dismantling there is a risk of damage to the surface finish of plasterwork and paintwork.

Attachment systems are also known wherein a plate or bracket acts both as a mechanical support and as an electrical connections with the supply cables ending in a plug connector attached mechanically to the finished walls. The lamp body may through sliding or by other manipulation become secured by means of a snap-on device and the electrical connection is made at the same time with means provided on both the bracket and the lamp body.

The system consisting of an open box housing which contains the electrical plug connector unit which is secured to the ends of the supply cables in the ceiling or wall and in which the said housing is attached to the surface by means of wall plugs is also known. The supporting frame, the diffuser and the remainder of the lamp are attached to the housing by means of a quick-attachment system incorporating bayonet attachments and the quick electrically connected the the box is offered up and electrically connected. The advantage of this system is its simple and quick attachment and disconnection, on the other hand, there remains the disadvantage that the lighting equipment is not watertight.

OBJECT OF THE INVENTION

The object of this invention is to provide an improvement to the systems used hitherto which in addition to retaining their advantages provides a system for the quick attachment of lighting which is watertight in accordance with legal requirements.

SUMMARY OF THE INVENTION

This and other objects which will appear more clearly below are all achieved by the improvement according to this invention wherein a central bracket or plate for quick attachment and connection of the completed lamp body by means of two or four screws or by means of suspending the bracket from two chains is attached either to a cable conduit or directly to the ceiling (or wall).

The central portion of the said bracket contains the electrical connector to which the supply cable is attached by means of watertight cable or conduit glands within a watertight box, and also a gasket fitted in a suitable seat around the perimeter ensures that the coupling with the lamp body is watertight once it has been fitted.

The watertight lamp can be fitted by pressure with a vertical movement (towards the ceiling) and it is mechanically secured by means of two or more movable brackets with hook ends which engage the sides or ends of the central supporting bracket or plate which are held in the locking position by means of compression springs.

Other objects and advantages will be more clearly seen from the following description and the appended plates which illustrate an imbodiment of the invention diagrammatically and by way of example.

SPECIFIC DESCRIPTION

Figure 1:
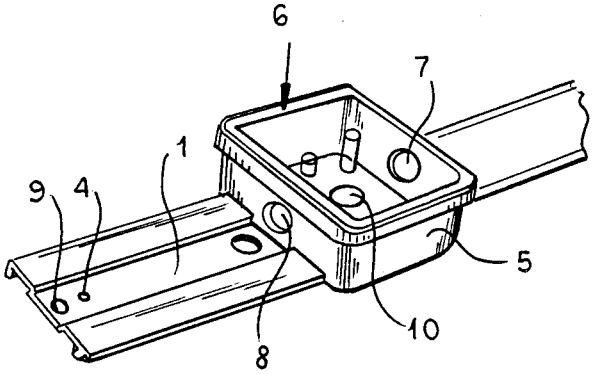
FIG. 1 shows the shaped bracket or plate to which the cable connection box and electrical connector is fitted.
Figure 2:
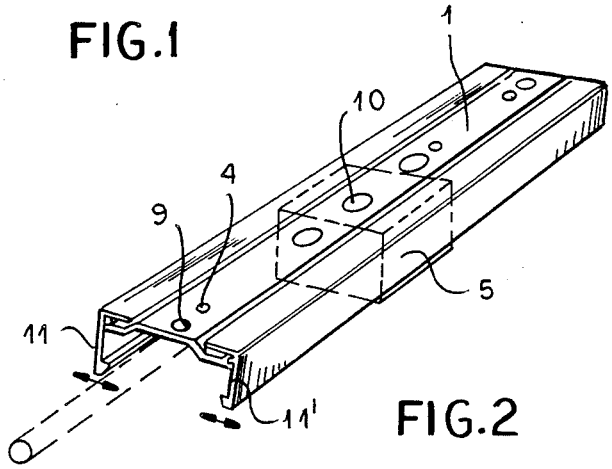
FIG. 2 shows the said bracket complete in its position of attachment to the ceiling, with the movable lateral hook brackets fitted.
Figure 3:
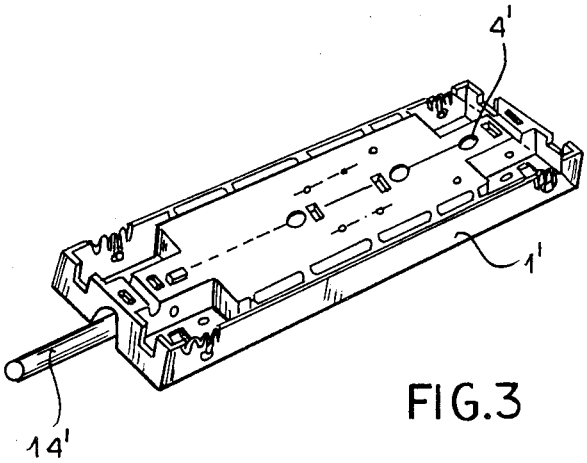
FIG. 3 shows the shaped bracket in an alternative version with end brackets (not shown, 2 housed on either side in the recesses provided for the purpose) in order to hook on the lamp body at its ends.

Shaped bracket or plate 1 and 1' (FIGS. 1, 2, 3) is fitted by means of screws 2 into expansion plugs 3 fixed in the ceiling or to a cable conduit 16. The screws are screwed through holes 4, 4' in the bracket and to this is fitted integral box 5 and 5' which acts as a container for the plug connection forming the electrical connection between the ends of the cables on the one hand and the male/ female plug connection with the lamp body on the other.

Box 5 and 5' include a seat 6, i.e. a channel which houses the gasket which forms the seal by contact with and after attachment of the lamp body. Holes 7 and 8 are provided for the watertight cable or conduit glands for the supply cables which may be guided in conduit 14 and 14', and these cables are connected as described above to the connector mounted on the said box (not shown in the figure).

Figure 4:
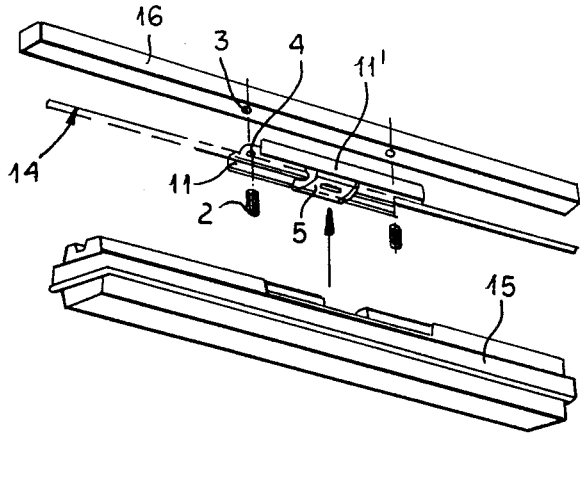
FIG. 4 shows the complete bracket in its position of attachment to the ceiling and the lamp body in a position ready to be hooked on for insertion under pressure with a vertical movement.
Figure 5:
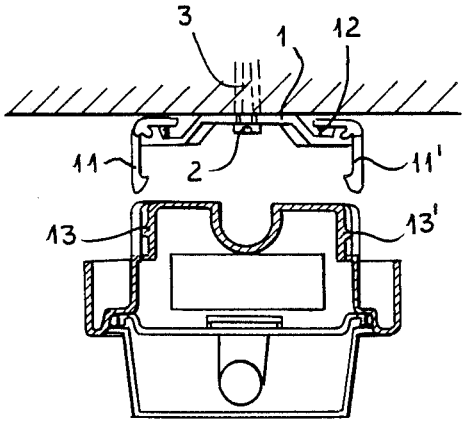
FIG. 5 shows a cross-section of both the bracket or plate attached to the ceiling and the lamp body before the connection with lateral hooks is mounted.

When mounted on the ceiling, bracket 1 (FIG. 2) has other holes 9 provided for possible suspension by means of chains and other holes 10 corresponding to posterior (superior) outlets for the supply cables. Movable hooked brackets 11 and 11' are fitted to the sides of bracket 1 (FIGS. 4, 5), held closed by compression spring 12 and the said movable brackets are notched shaped to engage corresponding seats 13 and 13' of watertight lamp body 15 (FIG. 4).

Figure 6:
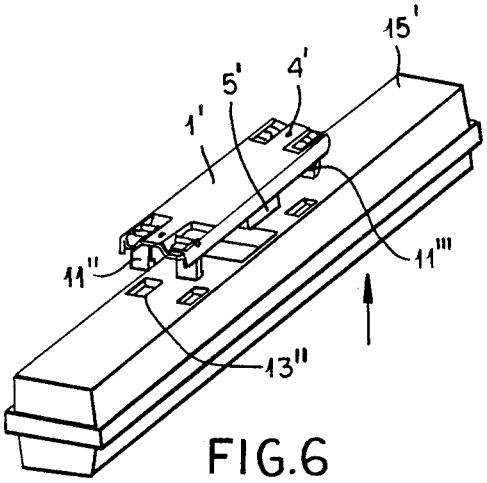
FIG. 6 shows the shaped bracket in an alternative version with hooks at the ends, in a position in which it is attached to the ceiling by means of screws and the lamp body is in a position ready for the end brackets to be hooked on for insertion under pressure with a vertical movement and securing of the brackets (not shown).

Movable hook brackets 11'' and 11''' (FIGS. 6, 7) which are held closed by compressions spring 12' (FIG. 7) are fitted in a similar way to the shaped bracket which hooks on to the ends of bracket 1 (FIG. 3) together with the movable brackets which are notched shaped. engage the corresponding seats 13'' in watertight lamp body 15' (FIG. 6). In this system of attachment, if axis 17 is rotated counterclockwise by 90° by means of a tool (spanner or screwdriver), the projection of opening 18 displaces tooth 19 of the hook (axis 20) by an angle such as to cause tooth 21 to leave seat 13''.

After it has been unhooked, the hook is prepared for subsequent reattachment by rotating axis 17 by 45° in a clockwise direction.

When it has been rehooked, the hook is again rotated about axis 17 by 45° clock wise placing projection 22 in a position where it provides a mechanical lock.

Both 18 and 22 are keyed to the same axis and are separated axially.

Figure 7:
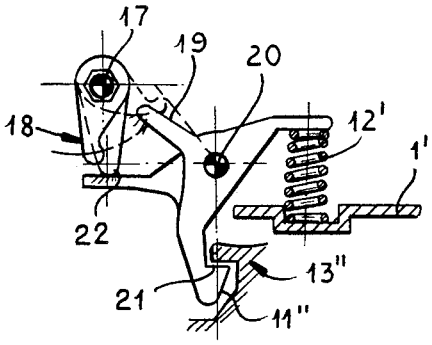
FIG. 7 shows a partial longitudinal cross-section through the bracket or plate in the alternative version attached to the ceiling by being hooked onto the movable end brackets and with a safety locking system.

The illumination system as a whole is hermetically sealed and attached to the ceiling by attachment lamp body 15 and 15' under pressure with a vertical movement which enables movable brackets 11 and 11' or 11'' and 11''' to engage, or by means of the system in FIG. 7.

As the male/female plug connector is located in box 5 and 5' ready for insertion, once the bracket assembly has been fixed to the ceiling and connected to the main electrical cables (FIGS. 4, 6) the fitter can make the mechanical and electrical connection to the lamp body and establish the watertight seal for the lighting system in a single simple and quick operation.

This invention which is illustrated and described diagrammatically and by way of example should be understood to be capable of extension to such additional variants as enter within its scopes.

In its practical embodiment the shapes, dimension and materials used may be of any kind according to requirements without thereby going beyond the scope of the protection of the following claims.

I claim:

1. A quick end connection system for a lamp, comprising:

a body supporting a watertight box for receiving electrical connectors from the lamp, a groove around a perimeter of said box having a gasket to provide a seal with the lamp, at least two spring loaded hooks for engaging and supporting the lamp, and means to attach and connect the body to a ceiling or wall.

2. The system defined in claim 1 wherein said body includes an electrical connector for engagement by a mounting connector of the lamp.

3. The system defined in claim 1 wherein the hooks are located along edges of said body.

* * * * *